US007703541B2

(12) United States Patent
Parks et al.

(10) Patent No.: US 7,703,541 B2
(45) Date of Patent: Apr. 27, 2010

(54) ROTARY ACTUATOR MECHANISM FOR A DOWNHOLE TOOL

(75) Inventors: Stephen Parks, Houston, TX (US); Alok Dwivedi, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 129 days.

(21) Appl. No.: 11/380,432

(22) Filed: Apr. 27, 2006

(65) Prior Publication Data

US 2007/0251696 A1 Nov. 1, 2007

(51) Int. Cl.
*E21B 34/06* (2006.01)

(52) U.S. Cl. ..... 166/386; 166/334.4

(58) Field of Classification Search ..... 166/72, 166/334.4, 104, 373, 386
See application file for complete search history.

(56) References Cited

U.S. PATENT DOCUMENTS

| | | | | |
|---|---|---|---|---|
| 4,635,678 | A | 1/1987 | Peterman et al. | |
| 5,373,898 | A * | 12/1994 | Pringle | 166/72 |
| 6,241,015 | B1 | 6/2001 | Pringle et al. | |
| 6,722,439 | B2 * | 4/2004 | Garay et al. | 166/373 |
| 6,860,330 | B2 | 3/2005 | Jackson | |

* cited by examiner

*Primary Examiner*—William P Neuder
(74) *Attorney, Agent, or Firm*—Trop, Pruner & P.C.; Daryl R. Wright; Rodney V. Warfford

(57) ABSTRACT

A tool that is usable with a well includes a movable element and a curved actuator. The curved actuator is adapted to move in a curved path that at least partially surrounds a longitudinal axis of the tool to actuate the element.

20 Claims, 6 Drawing Sheets

ROTARY ACTUATOR MECHANISM FOR A DOWNHOLE TOOL

BACKGROUND

The invention generally relates to a rotary actuator mechanism for a downhole tool.

A downhole tool is a device that performs a specific function in a well, such as, for example, controlling a production flow in the well. A typical downhole tool may include a piston that moves linearly along the longitudinal axis of the tool. The piston typically has a cylindrical form and is oriented to travel in a direction that is parallel to the longitudinal axis of the tool.

More specifically, the piston typically translates linearly along the longitudinal axis of the tool when subjected to hydraulic control pressure. The piston may be used for such purposes as shifting a sliding sleeve to selectively open and close apertures to control the flow of fluid through a valve, for example.

In some cases, a rotational motion may be needed in the tool. For these cases, the linear motion of the piston may be converted to a rotational motion through a rotational conversion mechanism such as a "J-slot." However, this approach may introduce a relatively inefficient energy conversion and its operation may be somewhat unreliable. Additionally, the use of a linear piston in combination with a rotational conversion mechanism has the inability to fail in a particular operational position, may be expensive, may be difficult to manufacture and may further add to the cost and complexity of the tool.

Thus, there exists a continuing need for better ways to produce rotational motion in a tool about its longitudinal axis.

SUMMARY

In an embodiment of the invention, a tool that is usable with a subterranean well includes a moveable element and an actuator. The actuator is adapted actuate the element.

In another embodiment of the invention, a technique that is usable with a subterranean well includes providing a valve to control communication of fluid in the well. The valve includes a valve sleeve that at least partially circumscribes a longitudinal axis of the sleeve. The technique includes actuating a piston to cause the piston to move in a path that at least partially circumscribes the longitudinal axis to control a position of the sleeve.

In another embodiment of the invention, a system that is usable with a subterranean well includes a string and a tool. The string is adapted to extend along a longitudinal axis, and the tool is part of the string. The tool includes a rotary piston to actuate the tool.

Advantages and other features of the invention will become apparent from the following drawing, description and claims.

DETAILED DESCRIPTION

Figure 1:
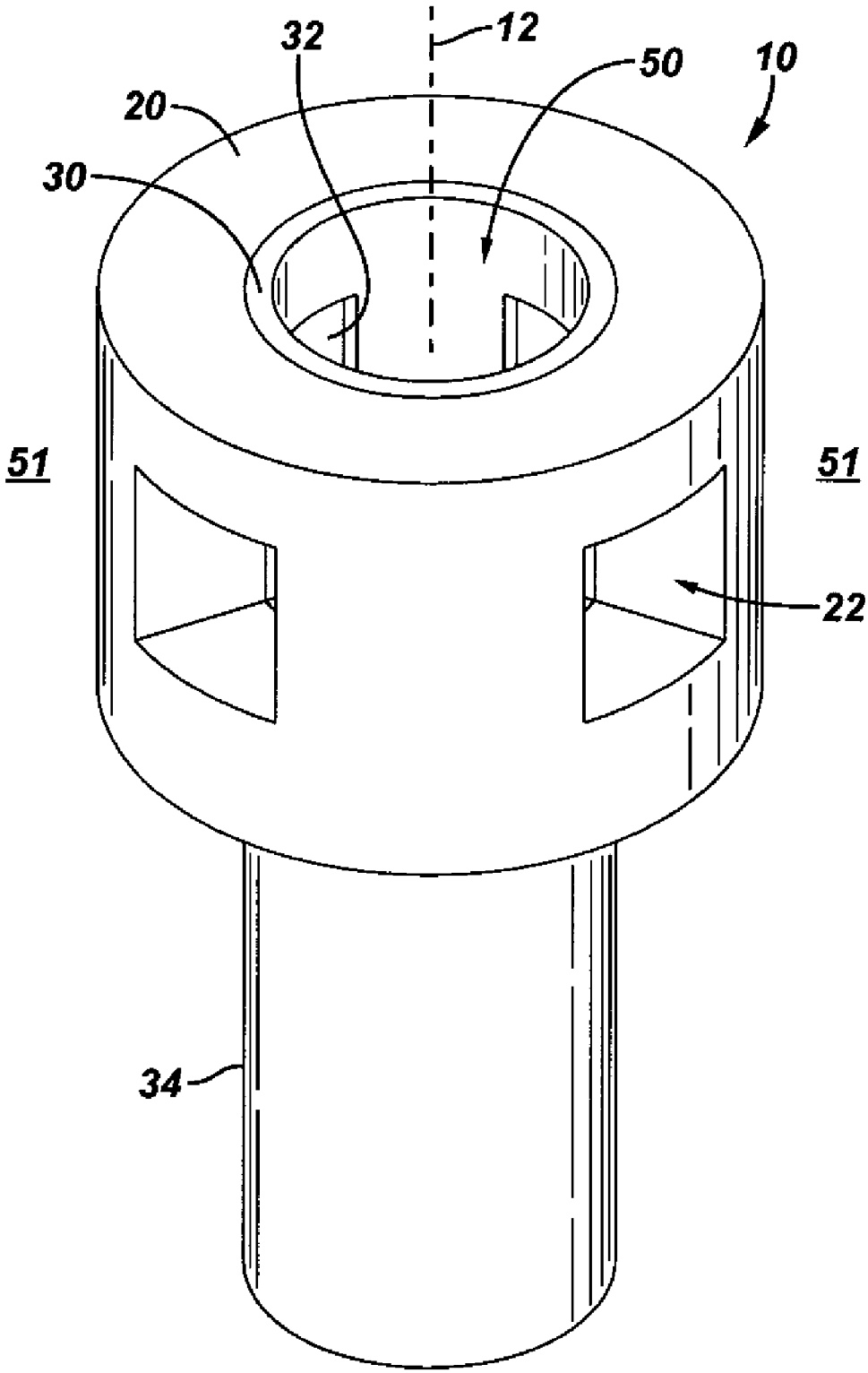
FIG. 1 is a top down perspective view of flow control elements of a flow control valve according to an embodiment of the invention.

FIG. 1 depicts certain flow control elements of a flow control valve 10 in accordance with an embodiment of the invention. These flow control elements include a main generally cylindrical body 20 that generally circumscribes a longitudinal axis 12 of the valve 10. The housing 20 includes radial ports, or windows 22, through which fluid may be communicated from an interior bore 50 of the tool 10 to a region 51 that surrounds the valve 10. More specifically, in accordance with some embodiments of the invention, the housing 20 circumscribes an interior sleeve 30 whose rotational position about the longitudinal axis 12 is manipulated for purposes of controlling fluid communication through the windows 22. In this regard, the sleeve 30 also circumscribes the longitudinal axis 12 and includes radial ports, or windows 32, to communicate fluid from the interior bore 50 (formed in the sleeve 30) and through the sleeve 30. It is noted that in other embodiments of the invention, the valve 10 may be eccentric, or have more than one main longitudinal axis: one axis that is collinear with the axis of the tubing string; and another, offset axis, around which most of the components of the tool operate. Thus, many variations are possible and are within the scope of the appended claims.

In accordance with some embodiments of the invention, the rotational position of the sleeve 30 with respect to the housing 20 is determinative of whether flow through the windows 22 is entirely shut off (i.e., the valve 10 is closed), flow through the windows 22 is fully open (i.e., the valve 10 is fully open) or some lesser degree of flow occurs through the windows 22. As further described below, unlike conventional valves, the valve 10 includes a rotary piston (not depicted in FIG. 1) that moves inside a bore that partially circumscribes the longitudinal axis 12 for purposes of rotationally positioning the sleeve 30 with respect to the housing 20. Due to this rotational positioning, the degree of flow through the valve 10 (i.e., the degree of flow between the windows 22 and 32) may be precisely regulated. Additionally, due to the use of a rotary piston, relatively efficient energy conversion is used, the operation of the valve 10 is more reliable, the valve 10 has the ability to fail in a particular operational position, and the valve 10 is relatively inexpensive and less complex, as compared to conventional valves. Other and different advantages are possible in other embodiments of the invention.

In accordance with some embodiments of the invention, power cycles are used to advance the rotary piston and thus, advance rotational position of the sleeve 30 in rotational increments, such as 90° increments (for example). In each power cycle, the rotary piston extends along its full path to advance the sleeve 30 by a predetermined 90° increment. It is noted that the 90° increment is merely an example, as other increments (smaller or larger) may be used in other embodiments of the invention.

Figure 2:
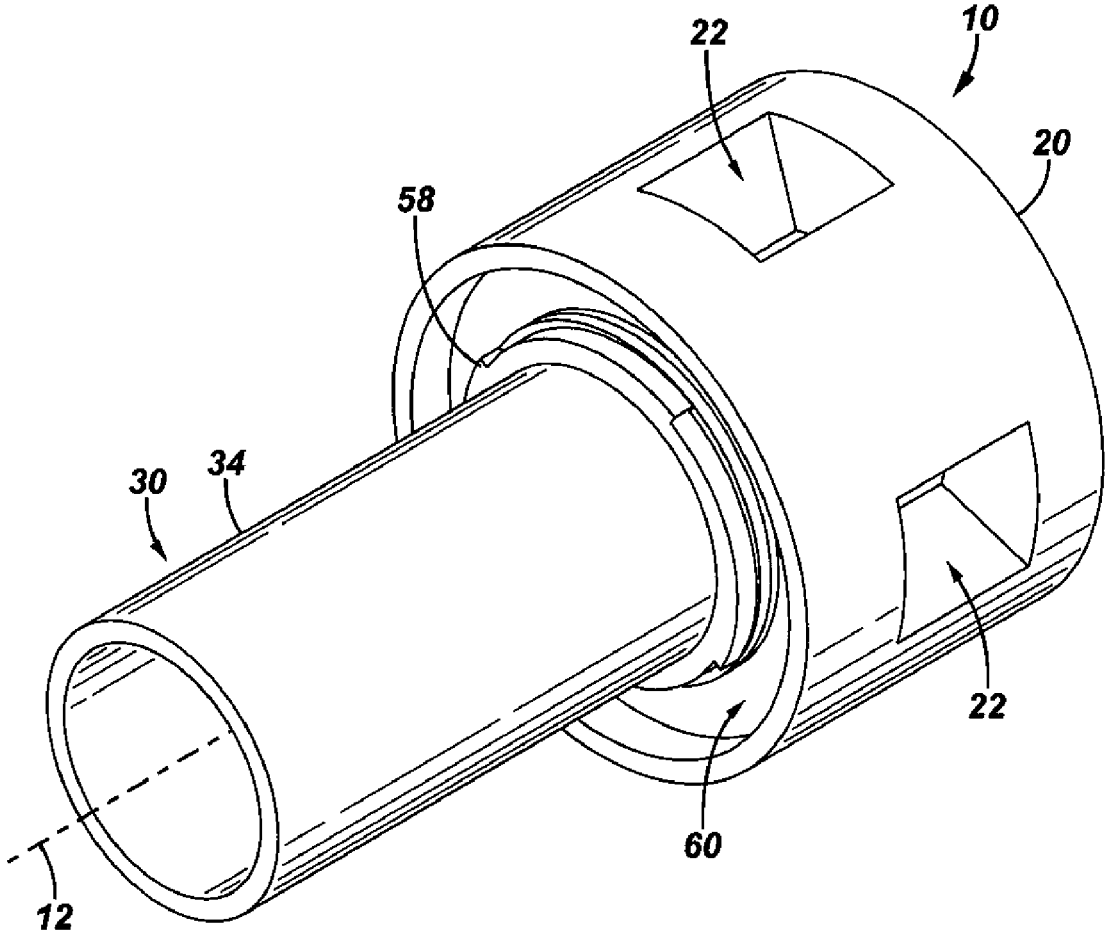
FIG. 2 is a bottom up perspective view of the flow control elements illustrating a ratchet mechanism of the valve according to an embodiment of the invention.

Referring to FIG. 2, in accordance with some embodiments of the invention, the valve 10 includes a ratchet mechanism for purposes of advancing the rotational position of the sleeve 30 in each power cycle. In this regard, in accordance with some embodiments of the invention, the housing 20 includes the bore in which the rotary piston (not depicted in FIG. 2) travels. The sleeve 30 includes a ratchet wheel 56, which contains ratchet teeth 58 that are engaged by a pawl (not depicted in FIG. 2) that moves with the rotary piston. As depicted in FIG. 2, in accordance with some embodiments of the invention, the ratchet teeth 58 are separated by 90° about the longitudinal axis 12. During each power cycle, the pawl engages one of the ratchet teeth 58 to rotate the sleeve 30 by 90° about the longitudinal axis 12. This rotation, in turn, resets the teeth 58 to have the same starting angular positions for the next power cycle.

As depicted in FIG. 2, in accordance with some embodiments of the invention, the ratchet wheel 56 is located at least partially inside an annular well 60 of the housing 20. The well 60 receives the ratchet wheel 56, which is connected to and circumscribes the sleeve 30. As further described below, the pawl that engages the ratchet wheel 56 resides in the well 60. As also shown in FIG. 2, a longitudinal extension 34 of the sleeve 30 extends outside of the well 60.

Figure 3:
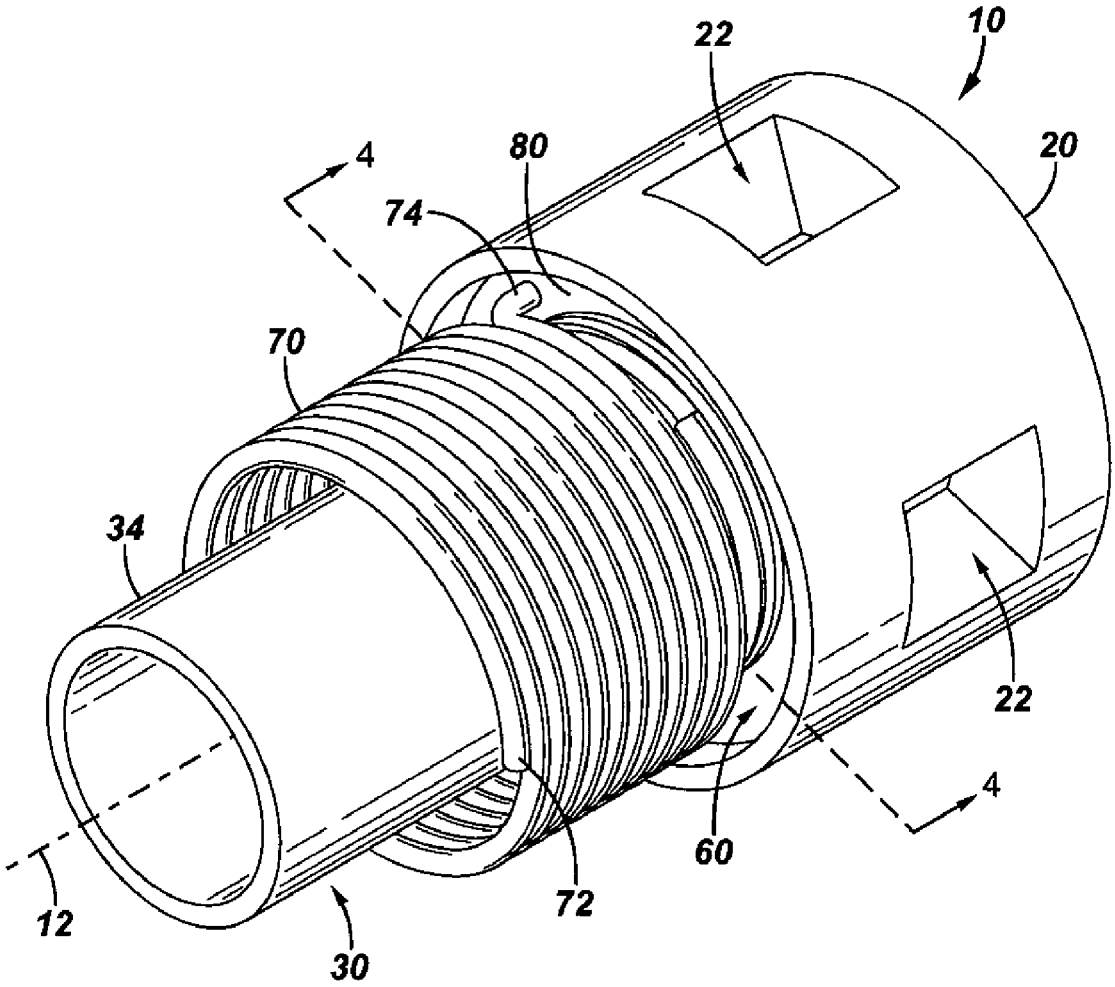
FIG. 3 is a bottom up perspective view of the valve illustrating certain aspects associated with the control of a sleeve of the valve according to an embodiment of the invention.

FIG. 3 depicts additional components of the valve 10 related to the control of the sleeve 30, including a coiled spring 70, which circumscribes the longitudinal axis 12. As further illustrated below, the spring 70 provides a stored energy source for purposes of restoring, or resetting, the rotary piston (not depicted in FIG. 3) of the valve 10 to its initial position at the conclusion of each power cycle. More specifically, in accordance with some embodiments of the invention, the rotary piston rotates in a counterclockwise direction about the longitudinal axis 12. The spring 70 is oriented about the longitudinal axis 12 to oppose the counterclockwise rotation by the rotary piston. Thus, the counterclockwise rotation of the rotary piston (which causes the sleeve 30 to also rotate in a counterclockwise direction) stores potential energy, or "winds," the spring 70. At the conclusion of the power cycle, the spring 70 unwinds to rotate the rotary piston back to its original position in a clockwise direction. In other embodiments of the invention, the pressure of the production fluid itself may also act to return the piston; and as another example of an embodiment of the invention, a gas charge may be used as a spring as well.

In some embodiments of the invention, the spring 70 may include a first end 72 that may be connected to, for example, the housing 20. Another end 74 of the spring 70, in turn, is connected to the rotary piston, as further described below.

Figure 4:
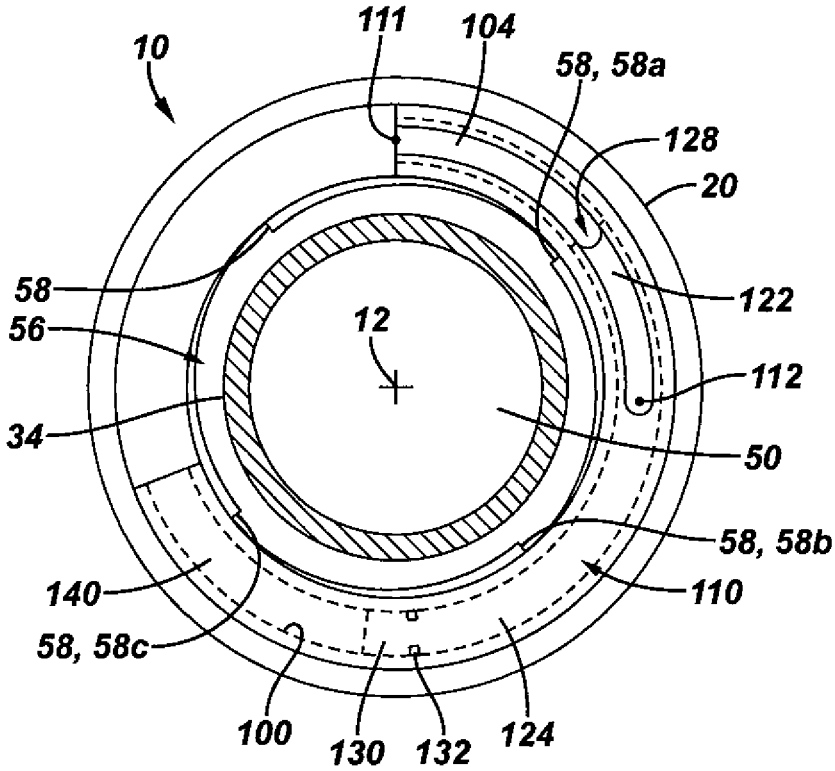
FIG. 4 is a cross-sectional view taken along line 4-4 of FIG. 3 according to an embodiment of the invention.

FIG. 4 depicts a cross-sectional view taken along line 4-4 of FIG. 3 and illustrates a rotary piston 110 of the valve in accordance with some embodiments of the invention. As shown in FIG. 4, the rotary piston 110 partially circumscribes, (i.e., the piston 110 is curved) about the longitudinal axis 12 and travels within a bore 100 that is formed in the housing 20 and also partially circumscribes the bore 12. As shown in FIG. 4, the bore 100 may have approximately twice the length of the rotary piston 10, in accordance with some embodiments of the invention.

The piston bore 100 is partially exposed to the well 60 (see FIGS. 2, 3 and 4), in accordance with some embodiments of the invention, for purposes of connecting the rotary piston 110 to the end 74 (see also FIG. 3) of the spring 70. Thus, the bore 100 includes an enclosed section 140 (see FIG. 4) that transitions (at point 112) to an open, or exposed section 104. The exposure of the bore 100 permits an end 122 of the rotary piston 110 to connect to the end 74 of the spring 70. More specifically, in accordance with some embodiments of the invention, the end 122 of the rotary piston 110 includes a curved indentation 128 for purposes of connecting the rotary piston 110 to the end 74 of the spring 70 or alternatively to a pin that extends to the end 84, depending on the particular embodiment of the invention. In these embodiments of the invention, the spring 70 connects to the disk 80 in a separate location. Several holes 51 (see FIG. 5) in the disk 80 serve as possible locations for the end of the spring 70 to allow for adjustment of the spring preload. Counterclockwise rotation of the rotary piston 110 about the longitudinal axis 12 causes corresponding winding of the spring 70 (see also FIG. 3).

In accordance with some embodiments of the invention, the exposed section 104 of the bore 100 extends approximately 90° around the longitudinal axis 12, which represents the distance that the rotary piston 110 travels during each power cycle. In other words, during each power cycle, the end 128 of the rotary piston 110 travels from the point 112 to a counterclockwise ending point 111 of the bore 100. At the conclusion of the power cycle, the potential energy that is stored in the spring 70 returns the end 128 back to the point 112 to reset the rotary piston 110 for another power cycle.

In accordance with some embodiments of the invention, the rotary piston 110 includes a piston head 130 that is sealed to the interior wall of the enclosed section 140 of the bore 100 via a fluid seal 132 that extends around the rotary piston 110. Due to the fluid seal 132, hydraulic pressure may be introduced into the enclosed section 140 of the bore 100 for purposes of forcing the rotary piston 110 in a counterclockwise direction about the longitudinal axis 12. One or more fluid communication ports (not depicted in FIG. 4) may be formed in the closed section 140 of the bore 100 for purposes of communicating the hydraulic fluid to the bore 100.

FIG. 4 depicts the ratchet wheel 56 during a power cycle in which the wheel 56 is partially rotated in a counterclockwise direction about the longitudinal axis 12. More specifically, for the state of the tool 10 that is depicted in FIG. 4, a ratchet tooth 58*a* of the ratchet wheel continues to be rotated during the power cycle from an angular position near the point 112 to a position near the end 111 of the bore 100. At the conclusion of this power cycle, the rotary piston 110 is reset, and the ratchet tooth 58*b* moves to the point 112. Thus, during the subsequent power cycle, the ratchet tooth 58*b* moves from the point 112 to the end 111 of the bore 100. Continuing the example, during the following power cycle, the ratchet tooth 58*c* is near the point 112. Thus, the ratchet wheel 56 continually rotates about the longitudinal axis 12, with each power cycle advancing the ratchet wheel 56 (and thus, the sleeve 30) by 90°, in accordance with some embodiments of the invention.

Figure 5:
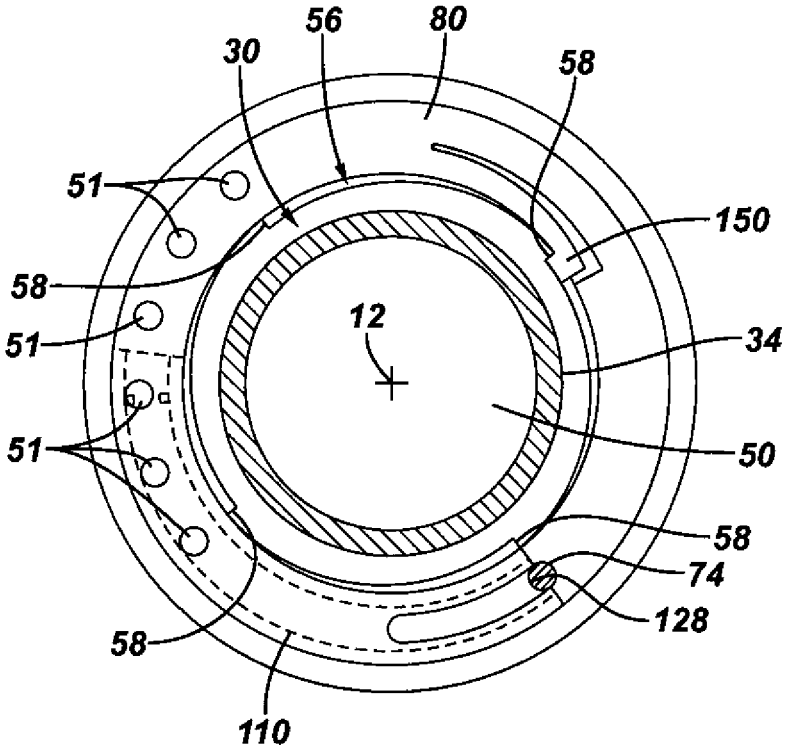
FIG. 5 is a cross-sectional view illustrating the ratchet mechanism of the valve according to an embodiment of the invention.

FIG. 5 depicts an annular ratchet disk 80 that circumscribes the longitudinal axis 12, resides in the well 60 (see also FIG. 3) of the housing 20 and includes a pawl 150 that engages one of the ratchet teeth 58 during each power cycle to rotationally advance the sleeve 30. The ratchet disk 80 is connected to the end 84 of the spring (by a pin or directly, as examples), which also connects to the rotary piston 110. In accordance with some embodiments of the invention, the disk 80 includes the openings 51, one of which may be connected to the end of the spring 70.

During each power cycle, the ratchet disk 80 rotates in a counterclockwise direction. Due to the engagement of the pawl 150 to a particular ratchet tooth 58 of the ratchet wheel 56, the sleeve 30 also rotationally advances with the disk 80 and the rotary piston 110. At the conclusion of the power cycle when hydraulic pressure is released on the rotary piston 110, the potential energy in the spring 70 rotates the disk 80 and rotary piston 110 back to their starting positions. However, due to the nature of the pawl 150 and the ratchet teeth 58, the pawl 150 disengages with the ratchet wheel 56 such that the sleeve 30 is not rotated in a clockwise direction with the disk 80 and rotary piston 110 as the position of the rotary piston 110 is reset.

It is noted that purposes of illustrating operation of the rotary piston, a flow control valve has been described herein. However, a flow control valve is one out of many possible downhole tools that contain a movable element, which may be actuated with a rotary piston. Thus, many variations are possible and are within the scope of the appended claims.

Figure 6:
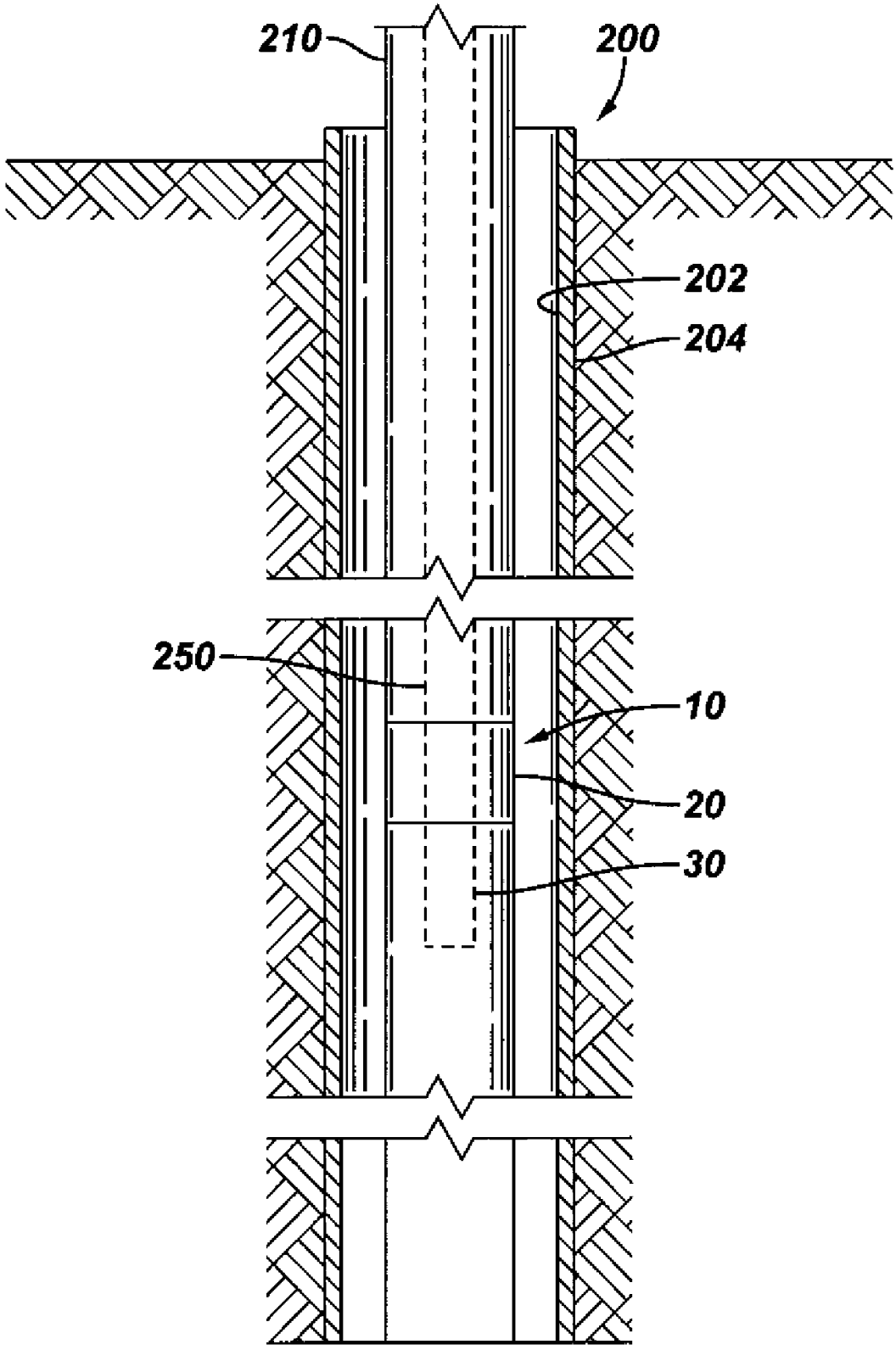
FIG. 6 is a schematic diagram of a well according to an embodiment of the invention.

Referring to FIG. 6, in accordance with some embodiments of the invention, the valve 10 (or other downhole tool) may be part of a string 210 that extends into a bore 202 of a well 200. The well 200 may be a subterranean or subsea well, depending on the particular embodiment of the invention. Additionally, although FIG. 6 depicts the well 200 as being cased by a casing string 204, it is noted that the valve 10 may be used in an uncased well in accordance with other embodiments of the invention. As shown in FIG. 6, the string 210 may include, for example, a passageway 250 that is in communication with the bore 50 (see FIG. 1, for example) of the valve 10.

Although the valve 10 is depicted as being part of a string 210, it is noted that the valve 10 may be run downhole via another conveyance mechanism, such as a wireline or coil-based mechanism. Additionally, the valve 10 may be retrievable. Thus, many variations are possible and are within the scope of the appended claims.

To summarize, the rotary piston 110 is an embodiment of a curved actuator that moves in a bore that at least partially circumscribes a longitudinal axis of a tool for purposes of moving a movable element. The movable element, as described above, is a sleeve. However, other movable elements may be used, as further described below. Additionally, a curved actuator other than a piston, may also be used in other embodiments of the invention, as further described below.

Figure 7:
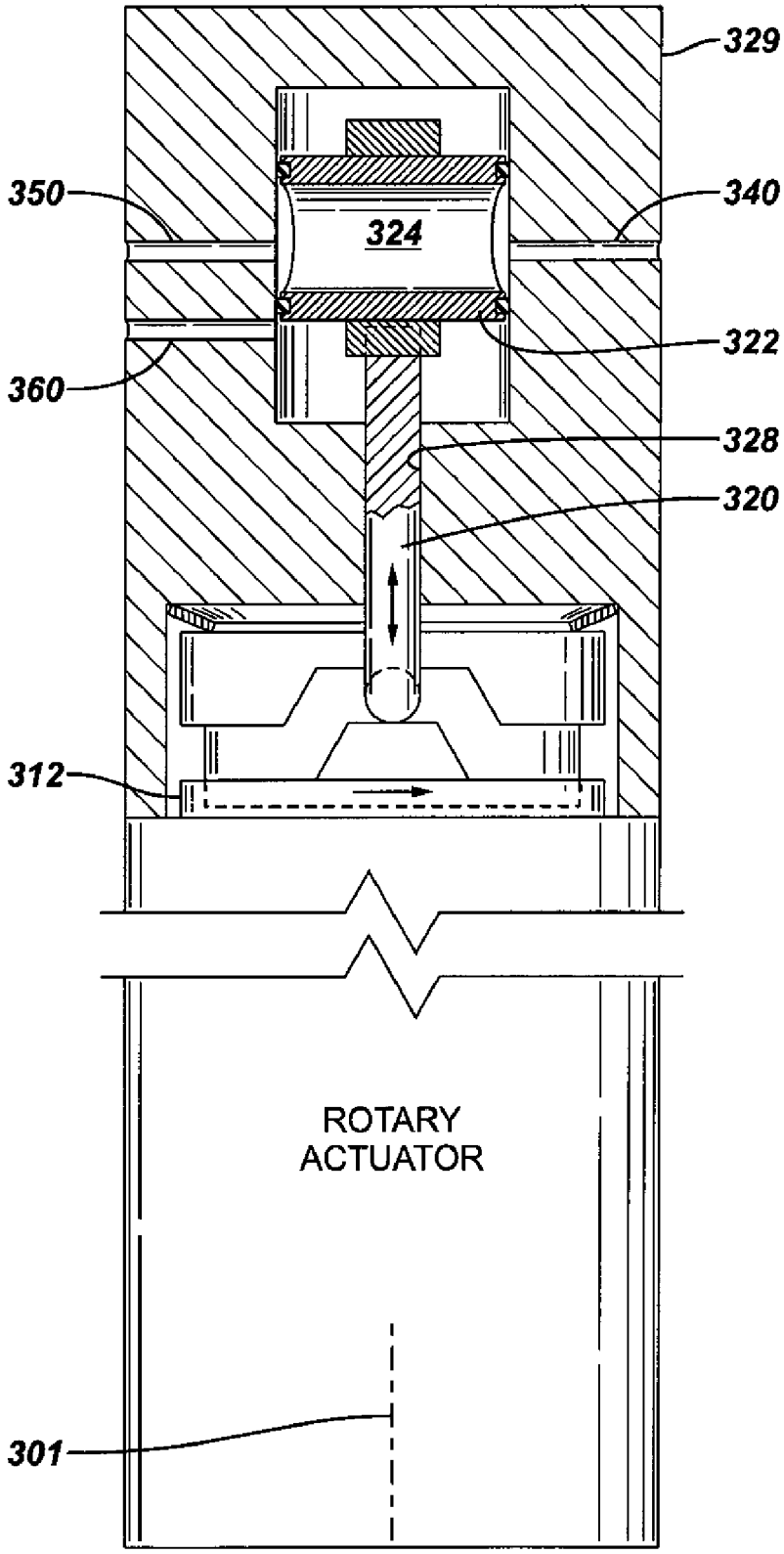
FIG. 7 is a schematic diagram of a valve according to another embodiment of the invention.

Movement of the movable element may occur along a linear path in accordance with some embodiments of the invention. For example, referring to FIG. 7, a valve 300 in accordance with an embodiment of the invention includes a rotary actuator 302, which contains a piston, or curved actuator, which moves to control the state of the valve 300. In this embodiment of the invention, the rotation of the curved actuator of the rotary actuator 302 turns a cam mechanism 312 about a longitudinal axis 301. The cam mechanism 312 moves in a helical groove 308 in a housing 329 of the valve 300.

The rotation of the cam 312 produces a corresponding linear translation in a longitudinal element 320 that is attached to a shuttle 322. The shuttle 322, in turn, includes a main passageway 324 that selectively establishes communication between an input passageway 340 (formed in the housing 329) and output passageways 350 and 360 (also formed in the housing 329). Therefore, depending on the particular position of the shuttle 322, communication occurs between the passageway 340 and one or more of the passageways 350 and 360. This communication is controlled via the rotation of the curved actuator of the rotary actuator 302.

In the embodiments that are depicted in FIGS. 1-7, a rotary mechanism is used for purposes of flow control. However, the rotary mechanism may be used for other device functions, such as for purposes of controlling a logic circuit and/or switching. In this regard, in accordance with some embodiments of the invention, a rotary mechanism may be used for purposes of forming a hydraulic distributor for purposes of multiplexing fluid between an input line and multiple output lines. In this regard, the radial ports 22 (see FIG. 1) of the valve 10 may alternatively be configured to be connected to output lines, and the input line of the distributor may be connected to the interior bore 50.

A rotary actuator may also be used, in accordance with some embodiments of the invention, for purposes of an orientation device. In this regard, a tool that contains the rotary actuator may be part of a secondary tool string that is inserted into the bore of a primary tool string for purposes of turning the primary tool string or a component of the string into a particular orientation. As another example, a rotary actuator may be used for purposes of deformation. In this regard, a rotary actuator-based device may be part of a secondary string that is lowered inside a flow tube of a flapper valve. In this regard, the rotary actuator-based tool may include a cam to push out dogs (as an example) to deform a lower end of the flow tube for purposes of permanently locking the flapper valve open. As another example, a rotary actuator-based tool may be eccentrically-disposed so that by rotating the piston of the tool, the tool may puncture a thin wall of a piston of a wireline valve, for example.

As another example of a potential embodiment of the invention, a rotary actuator-based tool may be a shifting tool whose curved actuator is moved for purposes of engaging and/or disengaging a particular tool. In a similar manner, the rotary actuator-based tool may be used for purposes of locking and unlocking a particular tool.

As an example of another device function, in accordance with some embodiments of the invention, a rotary actuator-based tool may be used for purposes of fluid type separation, in that the curved actuator of the tool may separate two fluids (a well fluid and a control fluid, as examples), which are located on either end of the actuator. The rotary actuator may also serve the function of pressure intensification, in that the curved actuator may have two piston head surfaces for purposes of intensifying the pressure that is applied to the actuate the curved actuator.

As another example, in accordance with some embodiments of the invention, a rotary actuator-based tool may be used for purposes of forming a pump. In this manner, the curved actuator may be moved in a reciprocal motion to pump fluid through a check valve, thereby forming a pump.

The valve 10 is described above as being moved in a forward direction by hydraulic pressure and being moved in the reverse direction by a spring. The valve 10 also includes a ratchet mechanism. However, in accordance with other embodiments of the invention, other driving energies may be used. For example, in accordance with some embodiments of the invention, a gas charge (gas stored in a chamber of the tool) may be used to either drive the curved actuator or return the actuator to a predetermined position. Similarly, wellbore pressure or annular pressure may perform a similar function.

In other embodiments of the invention, electromagnetic energy may be used to move the curved actuator. In this regard, in some embodiments of the invention, the curved actuator may be a solenoid, i.e., a curved ferromagnetic material (as an example) that is moved by a fixed coil that is wrapped around the bore for the actuator.

As yet another example, in accordance with some embodiments of the invention, a spring may be used to drive the curved actuator to a particular position. Thus, instead of increasing hydraulic pressure to move the actuator, pressure may be decreased to cause the actuator to move. In other embodiments of the invention, the curved actuator may be formed from opposing pistons and different drives in that one piston is driven to move the actuator in one direction, and the other piston is driven to move the actuator in the opposite direction. As yet another example, in accordance with some embodiments of the invention, an expanding phase change material may be used to drive the curved actuator. For example, wax may be disposed in a chamber that is in communication with a piston head of the actuator; and this wax may be heated to cause the wax to expand to drive the actuator. Thus, many variations are possible for the mechanism used to drive the curved actuator and are within the scope of the appended claims.

In accordance with other embodiments of the invention, the curved actuator may be driven in response to a one shot operation. In other words, a propellant or charge may be ignited or detonated downhole for purposes of a one-time operation in which the curved actuator is moved to perform some downhole function (such as opening a valve, for example).

The valve 10 includes a sleeve that is driven by the piston 110. However, in accordance with other embodiments of the invention, other mechanisms may be driven by the curved actuator. For example, depending on the particular embodiment of the invention, a disc, a ball (of a ball valve, for example), a ratchet, a screw (of a screw drive, for example), a valve (a poppet valve, for example), a switch, an electrical contact, a pump, another piston, gears or a cable may be driven in response to the movement by the curved actuator.

In accordance with some embodiments of the invention, a curved actuator may be directly connected to the driving energy, however, as described above for the valve 10 in accordance with other embodiments of the invention, the curved actuator may be indirectly connected to the driving mechanism, such as a ratchet connection, for example.

In accordance with some embodiments of the invention in which the curved actuator is formed from a piston, the piston may be rigid (a curved piece of rigid metal, for example) or may be flexible. In embodiments of the invention in which the piston is flexible, the piston may be made, for example, from a relatively small metal core and may be covered by a flexible outer coating, such as plastic. In accordance with other embodiments of the invention, the flexible piston may be formed from a helically-coiled strip. Thus, many variations are possible for forming a flexible piston. In accordance with other embodiments of the invention, the piston may be segmented, or formed from connected pieces.

The piston bore 100 is depicted above as following at least part of a circular path, i.e., a path that has a fixed radius. However, in the context of this application, the language "curved" is not to be limited to a path that has a fixed radius. Thus, in accordance with other embodiments of the invention, the piston bore may follow a non-circular curved path. Additionally, although the piston bore 100 is disclosed as residing in a particular plane, the curved bore 100 may also follow a non-planar path, such as a helical path that extends around the longitudinal axis, in accordance with other embodiments of the invention.

Although the rotary piston 110 moves with respect to the bore 100, it is understood that these roles may be reversed in other embodiments of the invention, i.e., the piston 110 may be remain stationary and the bore 100 may move with respect to the piston 110.

In accordance with other embodiments of the invention, the piston may not have a fixed cross-sectional diameter, but rather, the piston 110 may have a varying cross-sectional diameter. For example, in accordance with some embodiments of the invention, the piston may have a stepped diameter, for purposes of pressure intensification.

Additionally, instead of being pushed to move, the piston may be pulled, in other embodiments of the invention. Furthermore, the seals that are formed between the piston and bore may be formed from seals that reside in annular channels either on the piston or on the bore, depending on the particular embodiment of the invention.

For the valve 10, the piston 110 is depicted as remaining within the sealed bore 100. However, in accordance with other embodiments of the invention, the piston may be flexible and may be change directions after exiting a particular sealed bore. In this regard, an unsealed guide channel may be located at the exit of the bore so that the piston travels outside of the sealed bore in a particular curve path or linear path once the piston exits the sealed bore.

For embodiments of the invention in which the curved actuator forms a fluid separator, the actuator may be a rigid shuttle, a flexible shuttle, a shuttle in a short bore or a shuttle in a coiled tube. In this regard, a previously described above, the actuator may travel in a helical path.

Although the various arrangements for the piston and bore are described in terms of a "piston," it is noted that similar arrangements may be used in which the curved actuator is formed from an element other than a piston, such as a solenoid, for example.

As yet another embodiment of the invention, a rotary actuator-based tool may be used as a gas lift valve. More specifically, the gas lift valve may include radial ports that are moved by a curved actuator for purposes of selectively establishing communication between the central passageway of a tubing and the annulus of the well. Thus, in these embodiments of the invention, the gas lift valve does not require a side pocket to house the valve. The valve may likewise operate by rotating a disk. It is noted that in other embodiments of the invention, the rotary actuator-based mechanism may be partially or completely located in a side pocket, as many variations are possible and are within the scope of the appended claims.

As yet another example of application of a rotary actuator-based tool, the tool may be used to rotationally orient tools, instead of a mule shoe and may be used, for example, to expand dogs into a lock profile.

As yet other example of embodiments of the invention, a rotary actuator-based tool may be used in a safety valve. For example, the tool may be used as a lockout tool that rotate the sleeve in front of the flapper element of a flapper valve to hold it open. Alternatively, the tool may rotate the flow tube to lock the flapper valve open and may expand the flow tube to lock the flapper open. The rotary actuator-based tool may also be used in secondary communication in the safety valve to rotate to break a shear plug, for example.

While the present invention has been described with respect to a limited number of embodiments, those skilled in the art, having the benefit of this disclosure, will appreciate numerous modifications and variations therefrom. It is intended that the appended claims cover all such modifications and variations as fall within the true spirit and scope of this present invention.

What is claimed is:

1. An apparatus usable with a well, comprising:

a housing having at least one opening to communicate a fluid;

a piston bore;

a sleeve having an inner space; and an actuator adapted to move in the piston bore in a curved path that at least partially surrounds a longitudinal axis of the tool to control a flow of fluid between the inner space of the sleeve and said at least one opening of the housing.

2. The apparatus of claim 1, wherein the actuator comprises a piston.

3. The apparatus of claim 1, further comprising:

a ratchet mechanism to advance the movable element by rotational increments.

4. The apparatus of claim 3, wherein the ratchet mechanism comprises ratchet teeth.

5. The apparatus of claim 3, wherein the ratchet mechanism further comprises a pawl.

6. The apparatus of claim 5, further comprising:

a ring that includes the pawl.

7. The apparatus of claim 1, wherein the sleeve, housing and actuator form at least part of a valve.

8. The apparatus of claim 1, wherein the housing comprises the piston bore.

9. The apparatus of claim 8, wherein the piston bore at least partially circumscribes the longitudinal axis.

10. The apparatus of claim 1, wherein the actuator is adapted to be moved in response to hydraulic pressure.

11. The apparatus of claim 1, further comprising:

a mechanism to reset a position of the actuator to establish power cycles, each power cycle incrementally rotationally advancing the moveable element with respect to the housing.

12. The apparatus of claim 1, further comprising:

a string to extend into the well, wherein the sleeve, housing and actuator are part of the string.

13. A method usable with a well, comprising:

providing a valve to control communication of fluid in the well, the valve comprising a valve sleeve at least partially circumscribing a longitudinal axis; and actuating a piston to cause the piston to move in a piston bore in a curved path that at least partially surrounds the longitudinal axis to control a position of the sleeve, the actuating comprising rotating the sleeve by rotational increments about the longitudinal axis and each rotational increment being associated with a travel of the piston over the same path.

14. The method of claim 13, wherein the actuating comprises moving the sleeve about the longitudinal axis to control fluid communication between at least one opening of the sleeve and at least one opening of a housing surrounding the sleeve.

15. The method of claim 14, wherein the piston bore at least partially surrounds the longitudinal axis.

16. The method of claim 14, further comprising:

moving the piston in response to hydraulic pressure.

17. A tool usable with a well, comprising:

a moveable element;

an actuator adapted to move in a substantially non-planar and curved path that at least partially surrounds a longitudinal axis of the tool to actuate the element; and wherein the oath helically extends about the longitudinal axis.

18. The tool of claim 17, further comprising:

a ratchet mechanism to advance the movable element by rotational increments.

19. The tool of claim 17, further comprising:

a mechanism to reset a position of the piston to establish power cycles, each power cycle incrementally rotationally advancing the moveable element.

20. A method usable with a well, comprising:

actuating a piston to control a downhole tool, the actuating comprising moving the piston along a substantially non-planar and curved path that at least partially surrounds a longitudinal axis of the tool; and wherein the moving comprises moving the piston along a helical path.

* * * * *